US011753238B2

(12) United States Patent
Boesch et al.

(10) Patent No.: US 11,753,238 B2
(45) Date of Patent: Sep. 12, 2023

(54) RECEPTACLE COVER

(71) Applicant: TB Industries Inc., St. Michael, MN (US)

(72) Inventors: Travis Boesch, Burnsville, MN (US); Timothy Boesch, Monticello, MN (US)

(73) Assignee: TB Industries Inc., St. Michael, MN (US)

( * ) Notice: Subject to any disclaimer, the term of this patent is extended or adjusted under 35 U.S.C. 154(b) by 720 days.

(21) Appl. No.: 16/795,240

(22) Filed: Feb. 19, 2020

(65) Prior Publication Data

US 2020/0262646 A1 Aug. 20, 2020

Related U.S. Application Data

(60) Provisional application No. 62/807,501, filed on Feb. 19, 2019.

(51) Int. Cl.
*B65D 90/58* (2006.01)
*E05B 83/04* (2014.01)

(52) U.S. Cl.
CPC ..... *B65D 90/587* (2013.01); *B65D 90/582* (2013.01); *E05B 83/04* (2013.01); *B65D 2590/662* (2013.01); *B65D 2590/666* (2013.01)

(58) Field of Classification Search
CPC .. B65D 88/1675; B65D 88/14; B65D 88/129; B65D 88/127; B65D 88/126;
(Continued)

(56) References Cited

U.S. PATENT DOCUMENTS 2,758,744 A 8/1956 Spindler et al.
2,979,223 A * 4/1961 Rideout ..... A24F 19/00 220/812
(Continued)

FOREIGN PATENT DOCUMENTS

CA 2709598 A1 1/2012
CA 2869262 A1 5/2016
(Continued)

OTHER PUBLICATIONS

Schweitz1995, "Wastequip environmental plastic lid", https://www.youtube.com/watch?v=XeRw7SSGZmQ, Feb. 26, 2011.
(Continued)

*Primary Examiner* — Anthony D Stashick
*Assistant Examiner* — Raven Collins
(74) *Attorney, Agent, or Firm* — Patterson Thuente IP

(57) ABSTRACT

A cover assembly for a container including a frame having a rail, a cover coupled to the frame, a first opening mechanism including a first pivot and a first slide housing, and a second opening mechanism including a second pivot and a second slide housing, the rail of the frame being selectively and slidingly receivable in the first and second slide housings. The cover and frame are movable between three positions, a closed position, a first open position wherein the rail is partially disposed in the first slide housing and is disengaged from the second slide housing, and the frame, cover and first slide housing are rotated about the first pivot, and a second open position wherein the rail is partially disposed in the second slide housing and is disengaged from the first slide housing, and the frame, cover and second slide housing are rotated about the second pivot.

20 Claims, 17 Drawing Sheets

(58) Field of Classification Search
CPC ..... B65D 90/58; B65D 90/587; B65D 43/20; B65D 2590/662; B65D 43/18; B65D 43/16; B65D 43/161; B65D 2251/0053; B65D 2251/1083; E05B 83/04
USPC ..... 220/349
See application file for complete search history.

(56) References Cited

U.S. PATENT DOCUMENTS

| | | | | |
|---|---|---|---|---|
| 3,490,642 | A | 1/1970 | Friedlander | |
| 3,961,723 | A | 6/1976 | Eckel | |
| 4,821,902 | A | 4/1989 | May | |
| 4,853,985 | A | 8/1989 | Perry | |
| 4,934,562 | A | 6/1990 | Early et al. | |
| 4,991,238 | A | 2/1991 | Forrest | |
| 5,011,168 | A | 4/1991 | Deamicis | |
| 5,167,341 | A | 12/1992 | Morton et al. | |
| 5,244,109 | A | 9/1993 | Mullett et al. | |
| 5,251,775 | A | 10/1993 | Kruzick et al. | |
| 5,294,016 | A | 3/1994 | Crenshaw | |
| 5,533,643 | A | 7/1996 | Kruzick | |
| 5,641,171 | A | 7/1997 | Posey et al. | |
| 5,755,351 | A | 5/1998 | Kruzick | |
| 6,045,173 | A | 4/2000 | Tiesler et al. | |
| 6,250,729 | B1 * | 6/2001 | Allison | E05D 15/505 49/326 |
| 6,364,153 | B1 | 4/2002 | Petzitillo, Jr. et al. | |
| 6,364,154 | B2 | 4/2002 | Kruzick et al. | |
| 6,732,883 | B2 | 5/2004 | Petzitillo, Jr. et al. | |
| 7,093,731 | B2 | 8/2006 | Karpisek | |
| 9,434,539 | B2 | 9/2016 | Boesch | |
| 9,463,922 | B2 * | 10/2016 | Steiner | B60P 1/28 |
| 10,233,017 | B2 | 3/2019 | Boesch | |
| 10,272,814 | B2 | 4/2019 | Haag et al. | |
| 10,273,083 | B2 | 4/2019 | Boesch | |
| 10,737,849 | B2 * | 8/2020 | Corners | B65D 43/165 |
| 10,858,183 | B2 | 12/2020 | Boesch | |
| 2002/0017529 | A1 * | 2/2002 | Kruzick | B65F 1/1615 220/908 |
| 2013/0105486 | A1 | 5/2013 | Mashburn et al. | |
| 2016/0207707 | A1 | 7/2016 | Boesch | |
| 2016/0376101 | A1 | 12/2016 | Boesch | |
| 2018/0086186 | A1 * | 3/2018 | Haag | B60P 1/28 |
| 2019/0225421 | A1 | 7/2019 | Boesch | |

FOREIGN PATENT DOCUMENTS

| | | |
|---|---|---|
| FR | 2885891 | 11/2006 |
| FR | 2885891 A1 | 11/2006 |

OTHER PUBLICATIONS

Go Green Easy Glide Container Lid, "Going Green Easy Glide Container Lid—Southeastern Fabrications, LLC", https://www.youtube.com/watch?v=Y8vZJ2MqYfs, Feb. 24, 2009.
Confab Consolidated Fabricators Corp., "Ultra EZ-Flip Plastic Roof for Roll-Off", http://www.con-fab.com/ultra-ez-flip-plastic-roofs, dated prior to Jan. 20, 2014.
Confab Consolidated Fabricators Corp., "EZ Side Slide Roll-Off Covers", publication date unknown, accessed Jan. 7, 2016.
Application and file history for U.S. Appl. No. 14/600,740, filed Jan. 20, 2015, inventor Timothy Boesch, now U.S. Pat. No. 9,434,539, issued Sep. 6, 2016.
Application and file history for U.S. Appl. No. 15/228,556, filed Aug. 4, 2016, inventor Timothy Boesch, now U.S. Pat. No. 10,233,017, issued Mar. 19, 2019.
Application and file history for U.S. Appl. No. 15/085,356, filed Mar. 30, 2016, inventor Timothy Boesch, now U.S. Pat. No. 10,273,083, issued Apr. 30, 2019.
Application and file history for U.S. Appl. No. 16/258,053, filed Jan. 25, 2019, inventor Timothy Boesch, now U.S. Pat. No. 10,858,183, issued Dec. 8, 2020.
Schweitz1995, "Wastequip environmental plastic lid", https://www.youtube.com/watch?v=XeRw7SSGZmQ, Feb. 26, 2011, (0:23).
Go Green Easy Glide Container Lid, "Going Green Easy Glide Container Lid—Southeastern Fabrications, LLC", https://www.youtube.com/watch?v=Y8vZJ2MqYfs, Feb. 24, 2009, (2:20).
Confab Consolidated Fabricators Corp., "EZ Side Slide Roll-Off Covers", publication date unknown, accessed Jan. 7, 2016, 2 pgs.

* cited by examiner

RECEPTACLE COVER

CROSS-REFERENCE TO RELATED APPLICATIONS

This application claims the benefit of Provisional Application No. 62/807,501, filed Feb. 19, 2019, titled "Receptacle Cover," the disclosure of which is hereby incorporated by reference in its entirety.

TECHNICAL FIELD

The present invention relates generally to covers for containers, such as dumpsters or roll-off containers. More specifically, the present invention relates to environmentally sealing covers for large containers such as used in the construction, manufacturing, or environmental cleanup industries.

BACKGROUND

In the construction, manufacturing, and environmental cleanup industries, large containers, such as dumpsters or roll-off containers, are used to collect and contain debris and waste associated with demolition, renovation, clean-up and/or construction. One such type of large container is referred to as a roll-off container, usually featuring a rectangular footprint so as to be easily transportable by truck. Roll-off containers are configured to be delivered and removed via specialized trucks which allow the container to rolled off the truck and put into place. Such trucks utilize tilting beds, cable and winch systems, and/or hooks in order to facilitate loading and unloading the roll-off container from the truck. Alternately, large containers may be delivered and removed via a truck having a crane. These large containers are sized according to volume, with common container sizes in the United States having between ten and forty cubic yard capacities.

In the construction industry, for example, construction debris may originate from a building site where structures are being built, renovated, or demolished. Large containers are used to remove the construction debris from the building site. Further, environmental clean-up jobs usually require a large amount of environmentally hazardous material to be contained and removed via large container. The material in the large container may be taken to a landfill, recycled or otherwise properly disposed of.

While large containers typically include an open top, in some of the aforementioned applications it may be desirable to cover the large container. For example, to comply with environmental regulations regarding storm water exposure, to provide protection from theft or unauthorized dumping, and/or to otherwise protect against unwanted or unauthorized access to the large container, a cover may be required. One such type of cover may be a tarpaulin, which is inexpensive but can be cumbersome to handle and ineffective at securely protecting the large container and its contents. Another type of cover in use is constructed of heavy duty steel, which provides excellent security but is expensive and relatively heavy, requiring specialized equipment to open and close the cover. Additionally, neither tarpaulin or heavy duty steel covers can provide an environmental seal on their own, as would be needed in hazardous waste cleanup sites.

SUMMARY

Disclosed herein are embodiments of a container cover system for use in covering containers, such as large containers used for waste disposal. The container cover system disclosed herein is an example of a sealable bidirectional hinging cover. The container cover system includes a container, cover, and a plurality of bidirectional hinge assemblies. The cover and bidirectional hinges are configured to allow the cover to slide and rotate open over a first and a second side of a container. In sealing embodiments, the cover and bidirectional hinges are configured to be movable between an open position and a sealed position, so as to selectively seal or unseal an opening of a container. In another embodiment, the container cover system can be configured to cover an opening of a container without substantially sealing the container.

In one embodiment, the present disclosure provides a cover assembly for a container, comprising a frame, including a rail, and a cover coupled to the frame. The cover assembly further comprises a first opening mechanism including a first pivot and a first slide housing, and a second opening mechanism including a second pivot and a second slide housing, the rail of the frame being selectively and slidingly receivable in the first and second slide housings. The cover and frame are movable between three positions, a closed position which substantially covers an opening of the container, a first open position wherein the rail is at least partially disposed in the first slide housing and is disengaged from the second slide housing, and the frame, cover and first slide housing are rotated about the first pivot to allow access to a substantial portion of the opening of the container, and a second open position wherein the rail is at least partially disposed in the second slide housing and is disengaged from the first slide housing, and the frame, cover and second slide housing are rotated about the second pivot to allow access to a substantial portion of the opening of the container.

In another embodiment, the present disclosure provides a cover assembly for a container, comprising a frame, including a rail and a seal, the seal being configured to engage an opening of the container, a cover coupled to the frame, and a cover support assembly including a lifting support bracket and one or more cover locks, the cover locks coupled to a first and second end of the lifting support bracket, the cover locks configured to raise and lower the lifting support bracket. The cover assembly further comprises a first opening mechanism including a first pivot and a first slide housing, the first opening mechanism coupled to the first end of the lifting support bracket, a second opening mechanism including a second pivot and a second slide housing, the second opening mechanism coupled to the second end of the lifting support bracket, the rail of the frame being selectively and slidingly receivable in the first and second slide housings. The cover and frame are movable between three positions, a closed position which substantially covers the opening of the container and the cover support assembly is in a lowered position such that the seal is coupled to the opening of the container, a first open position wherein the rail is at least partially disposed in the first slide housing and is disengaged from the second slide housing, and the frame, cover and first slide housing are rotated about the first pivot to allow access to a substantial portion of the opening of the container, and the cover support assembly is in a raised position such that the seal is not coupled to the opening of the container, and a second open position wherein the rail is at least partially disposed in the second slide housing and is disengaged from the first slide housing, and the frame, cover and second slide housing are rotated about the second pivot to allow access to a substantial portion of the opening of the container, and the cover support assembly is in a raised position such that the seal is not coupled to the opening of the container.

In another embodiment, the present disclosure provides a cover system for a container, comprising a cover assembly including a frame, a cover coupled to a top portion of the frame, one or more rails coupled to a side portion of the frame, and a seal coupled to a bottom portion of the frame, the seal configured to engage with an opening of the container. The cover system further comprises one or more hinge assemblies slidably coupled to the one or more rails of the cover assembly, one of the one or more hinge assemblies including a lifting support bracket, a first opening mechanism including a first pivot and a first slide housing, the first opening mechanism coupled to the first end of the lifting support bracket, a second opening mechanism including a second pivot and a second slide housing, the second opening mechanism coupled to the second end of the lifting support bracket, the rail of the frame being selectively and slidingly receivable in the first and second slide housings, and one or more cover locks, the cover locks coupled to a first and second end of the lifting support bracket, the cover locks configured to raise and lower the lifting support bracket such that the seal raises or lowers to engage with the opening of the container.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
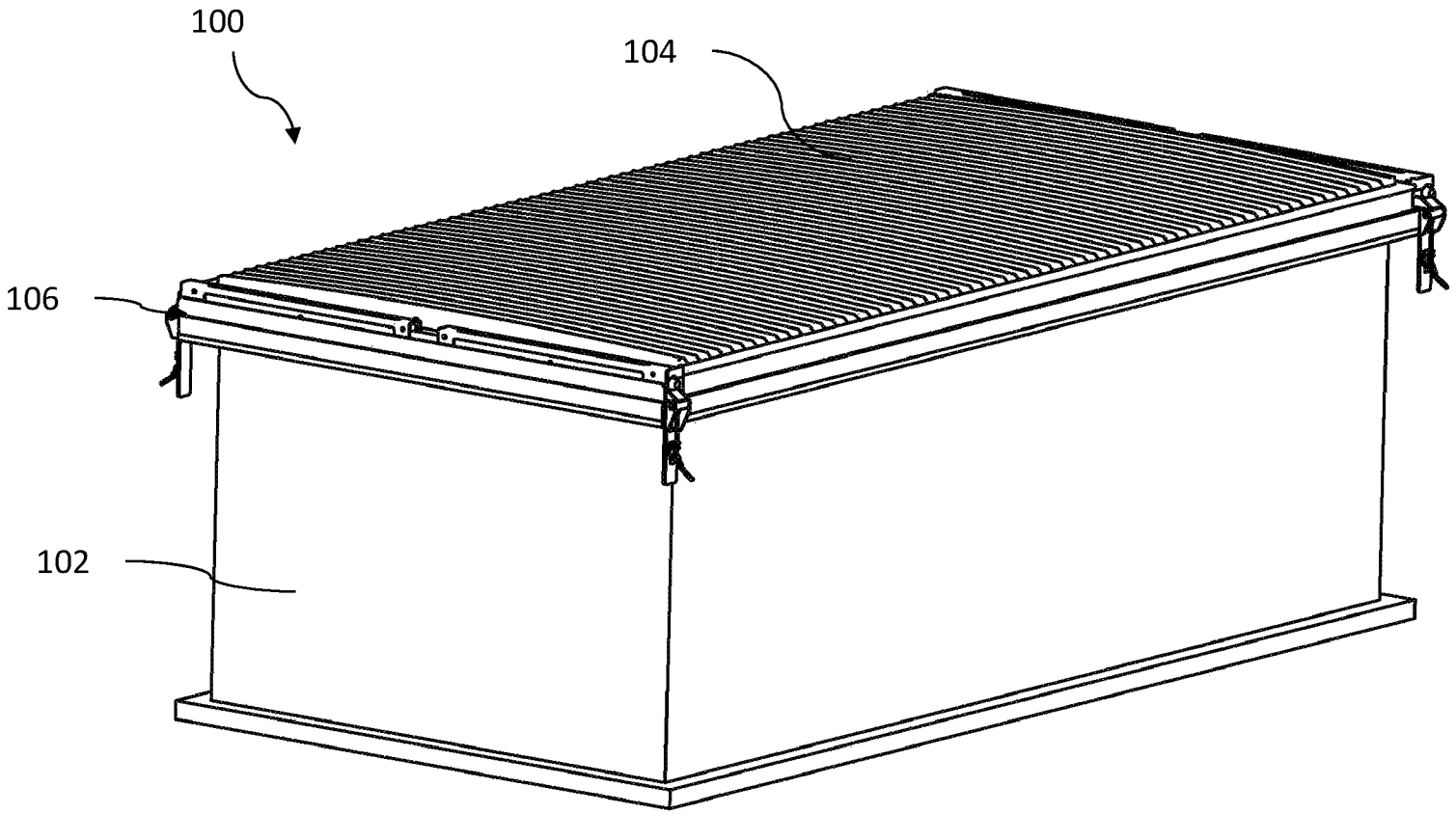
FIG. 1 is an isometric view of a container cover system in a closed position, according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Disclosed herein are various embodiments of a container cover system including a cover and one or more bidirectional hinges for use in covering various waste containers. The cover is configured to transition from a closed position to an open position on either side of the container via the bidirectional hinges. In some embodiments, as disclosed below, the container cover system can also incorporate a sealing function such that in the closed position, the internal contents of the waste container are substantially sealed from the external environment.

Referring to FIG. 1, a container cover system 100 for use with a container 102 is depicted. In an embodiment, container cover system 100 includes a cover assembly 104, and a plurality of bidirectional cover opening mechanisms 106. Cover assembly 104 is slidably coupleable to bidirectional cover opening mechanisms 106 arranged on either end of container 102. Cover assembly 104 is further configured to selectively cover an open top portion of container 102. The plurality of bidirectional cover opening mechanisms 106 are coupled to container 102 such that cover assembly 104 can rotate open via the plurality of bidirectional cover opening mechanisms 106.

Figure 2A:
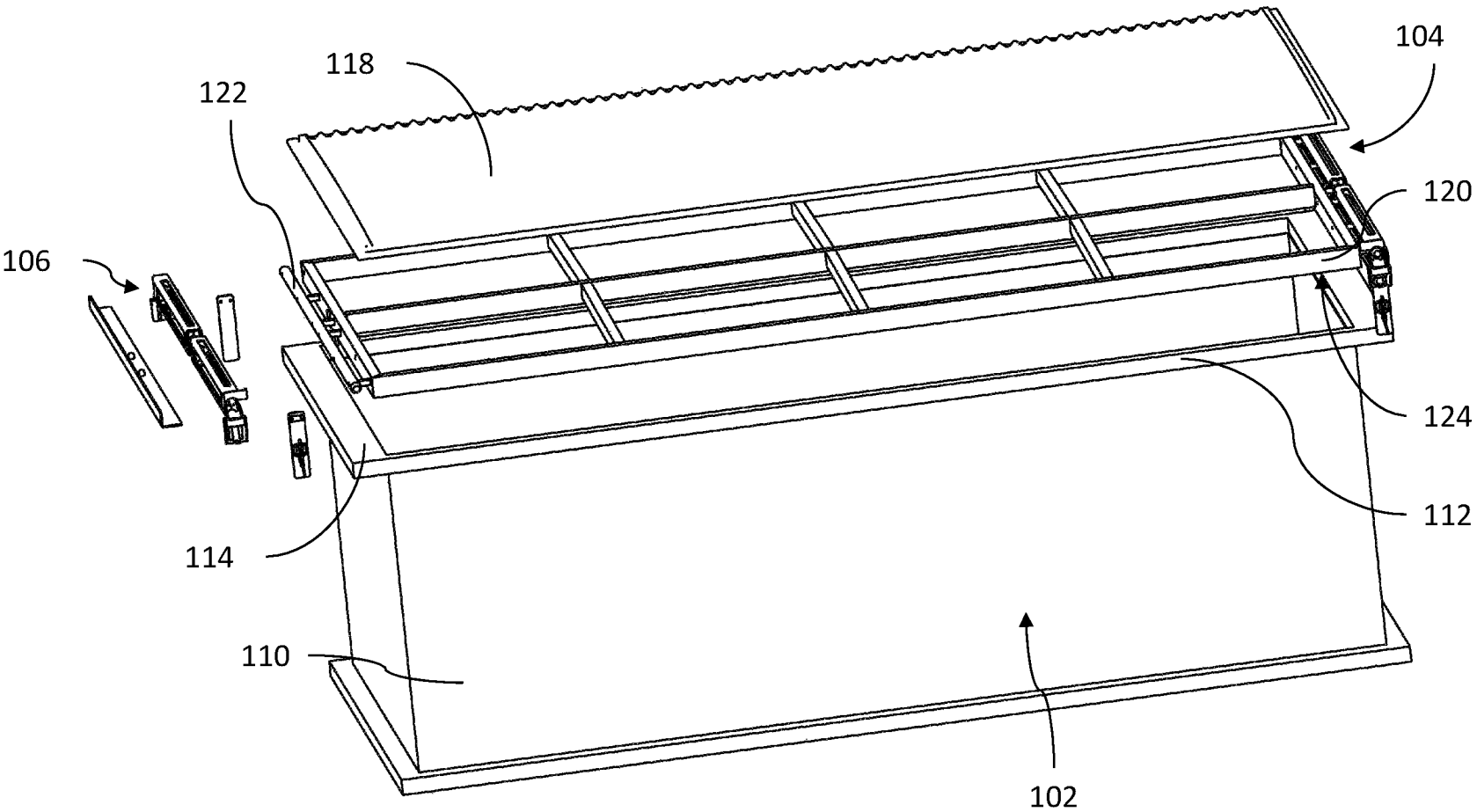
FIG. 2A is a partial exploded view of the container cover system of FIG. 1.

Referring now to FIG. 2A, container 102 can further include a container housing 110 and an upper collar 112. In an embodiment, container housing 110 defines a containment portion such that waste material can be received in container housing 110. Upper collar 112 is coupled to a top portion of housing 110. Upper collar 112 further defines an opening to the containing portion of container housing 110. Further, upper collar 112 includes a sealing surface 114. Container 102 can take various forms, and embodiments disclosed herein are for illustrative purposes only. Container 102 can be made of various materials such as steel or other metals, wood, plastic, or other manufactured material suitable for waste material containment.

In an embodiment, cover assembly 104 can include a cover top 118, cover frame 120, and cover rails 122. Cover top 118 is fixedly coupled to cover frame 120 and is sized and shaped to substantially cover the opening of the containing portion of container housing 110. Cover top 118 can be made of various materials such as steel or other metals, wood, plastic, or other manufactured material suitable for covering waste material. Cover frame 120 includes a plurality of structural beams configured to support cover top 118.

Cover rails 122 are fixedly coupled to a first end and a second end of cover frame 120 via a plurality of rail mounts 126. Cover rails 122 can have a cylindrical shape with substantially beveled ends. Cover rails 122 are sized and shaped to support cover assembly 104 and slidably move within the plurality of bidirectional cover opening mechanisms 106.

Cover frame 120 also includes a seal 124 arranged on a lower portion of cover frame 120. Seal 124 is configured to seal-ably couple cover assembly 104 to container 102 at sealing surface 114. Seal 124 can be made of natural or synthetic rubber in solid or expanded form, or any other material suitable for creating a water or air-tight seal. Cover assembly 104 is configured to move vertically a predetermined distance such that cover frame 120 can be disposed in a lowered position or a raised position. In the lowered position, cover frame 120 is positioned such that seal 124 is in contact with sealing surface 114 of upper collar 112. Raised position includes cover frame 120 being positioned such that cover assembly 104 is spaced apart from sealing surface 114 of upper collar 112 to facilitate opening of cover assembly 104. Persons skilled in the art will appreciate that aspects of container cover system 100 may be adjusted so as to vary the amount seal 124 is compressed when in the lowered position, as well as the height of cover assembly 104 in the raised position.

Figure 2B:
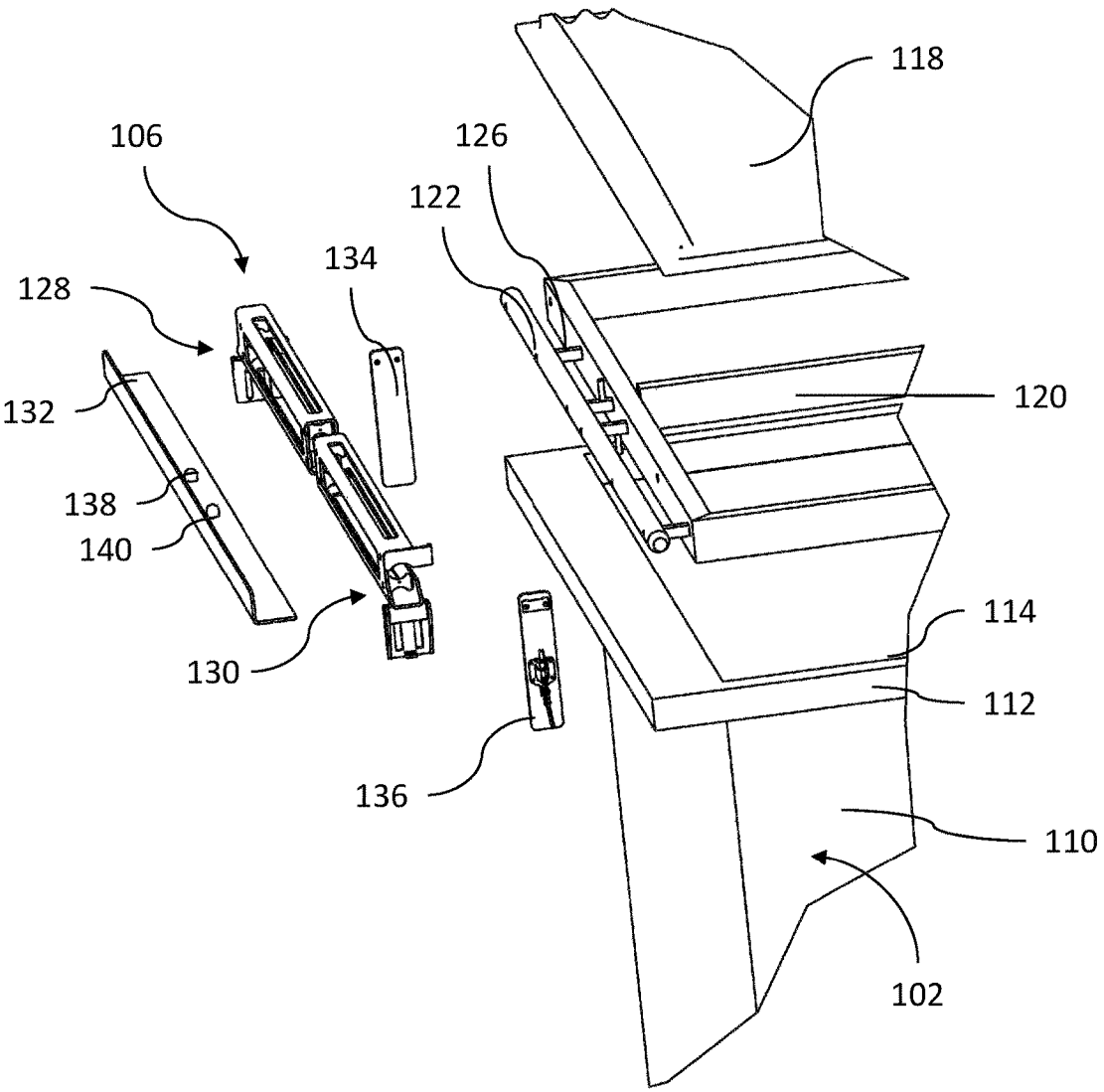
FIG. 2B is a close-up exploded view of a portion of the container cover system of FIG. 1.

Referring now to FIG. 2B the first end and the second end of container cover system 100 are substantially similar and construction of only one end will be described below as it applies equally to the construction of the second end. In an embodiment, bidirectional cover opening mechanism 106 includes a first cover hinge assembly 128, a second cover hinge assembly 130, a support bracket 132, a first lift mount plate 134 and a second lift mount plate 136. Bidirectional cover opening mechanism 106 components can be made of steel, aluminum, other suitable metal material, plastic, or other suitable manufactured material. First cover hinge assembly 128 is hingedly coupled to a first end of support bracket 132 and second cover hinge assembly 130 is hingedly coupled to a second end of support bracket 132. Support bracket 132 is sized and shaped to span the length of an end of upper collar 112.

Support bracket 132 also includes a first centering pin 138 and a second centering pin 140. First centering pin 138 is configured to be received by corresponding alignment apertures arranged on first cover hinge assembly 128. Second centering pin 140 is configured to be received by corresponding alignment apertures arranged on second cover hinge assembly 130. First lift mount plate 134 and second lift mount plate 136 are configured to fixedly mount to upper collar 112 of container housing 110 adjacent an end of container 102. First lift mount plate 134 and second lift mount plate 136 are configured to slidably couple to a first and second end of support bracket 132, respectively, as will be discussed in greater detail below.

Figure 3:
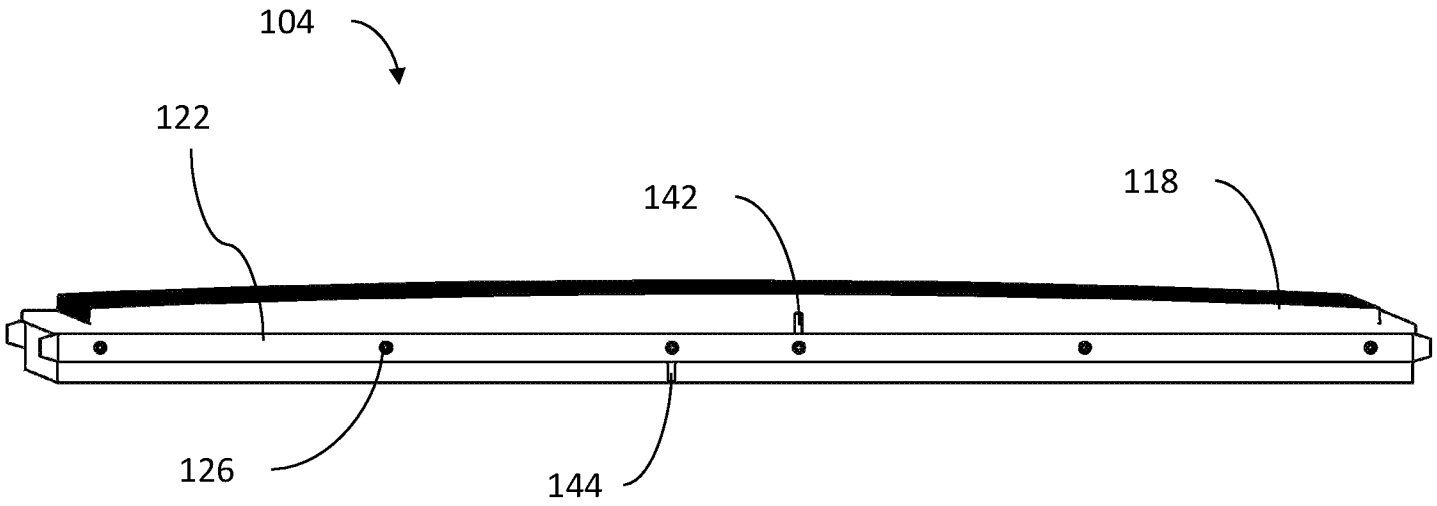
FIG. 3 is a partial side view of a cover assembly of the container cover system of FIG. 1.

Referring now to FIG. 3, cover rails 122 include a first stop 142 and a second stop 144. First stop 142 and second stop 144 can comprise a bolt, shaft, peg or other suitable structure or protrusion. First stop 142 and second stop 144 are each coupled to one of rail mounts 126. First stop 142 and second stop 144 are arranged such that first stop 142 protrudes upwardly while second stop 144 protrudes downwardly. In another embodiment, first stop 142 and second stop 144 are arranged such that first stop 142 protrudes downwardly while second stop 144 protrudes upwardly. First stop 142 and second stop 144 are further arranged along the length of cover rails 122 such that first stop 142 and second stop 144 are offset from the center of cover rails 122 by a small distance (e.g., up to 18 inches). In another embodiment, the offset distance of first stop 142 and second stop 144 with respect to the center of cover rails 122 may be greater than 18 inches.

Referring now to FIGS. 4A-4F, first cover hinge assembly 128 is substantially similar to second cover hinge assembly 130 with the exception of location of stop plates 163, 164. Because first cover hinge assembly 128 is substantially similar to second cover hinge assembly 130, only first cover hinge assembly 128 is described below, but said description applies to the construction of second cover hinge assembly 130. First cover hinge assembly 128 includes a slide housing 150. Housing 150 of first cover hinge assembly 128 is configured to hingedly rotate with respect to support bracket 132 between an open position and a closed position. In the closed position, first cover hinge assembly 128 is configured to receive a corresponding centering pin 138. Similarly, housing 150 of second cover hinge assembly 130 is configured to hingedly rotate with respect to support bracket 132 between an open position and a closed position. In the closed position, second cover hinge assembly 130 is configured to receive a corresponding centering pin 140.

Slide housing 150 includes a first roller set 152 and first roller mount 154 arranged approximate a first end 155. Slide housing 150 also includes a second roller set 156 and second roller mount 158 arranged approximate a second end. Slide housing 150 further includes a slide channel 162. Slide channel 162 is sized and shaped to allow rail mounts 126 of cover rails 122 to pass unobstructed. First roller set 152 is rotatably coupled to first roller mount 154. Second roller set 156 is rotatably coupled to second roller mount 158. First roller set 152 is configured to rotatably couple to cover rails 122 at first roller mount 154. Second roller set 156 is configured to rotatably couple to cover rails 122 at second roller mount 158. Cover rails 122 are configured to move translatably, via first roller set 152 and second roller set 156, along the length of bidirectional cover opening mechanism 106. Rail mounts 126 of cover rails 122 pass unobstructedly through slide channel 162 during translatable movement. Further, cover rails 122 roll across first roller set 152 and second roller set 156 to allow translating movement of cover assembly 104 with respect to container 102.

Figure 4A:
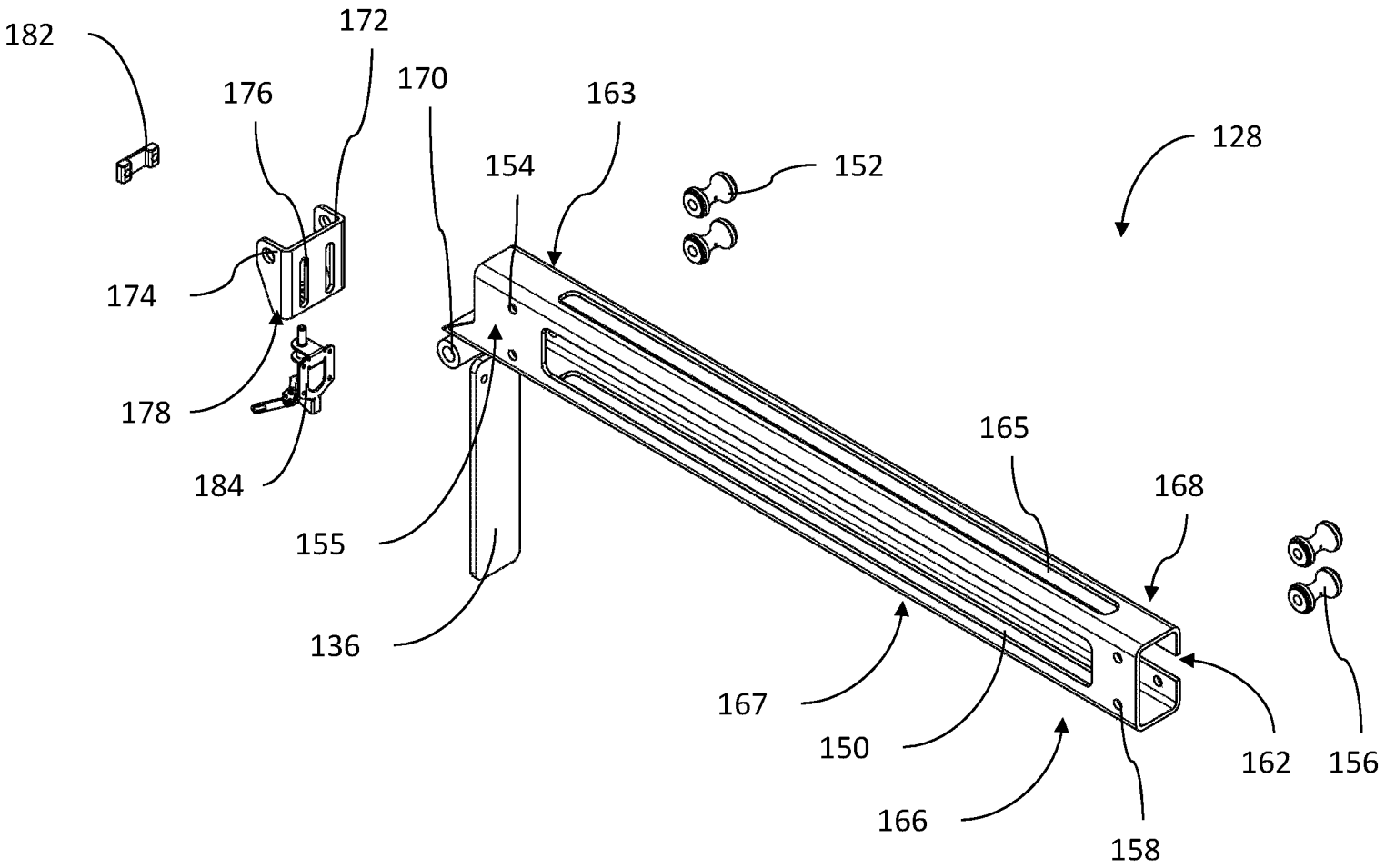
FIG. 4A is an exploded view of a bidirectional hinge assembly of the container cover system of FIG. 1.
Figure 4C:
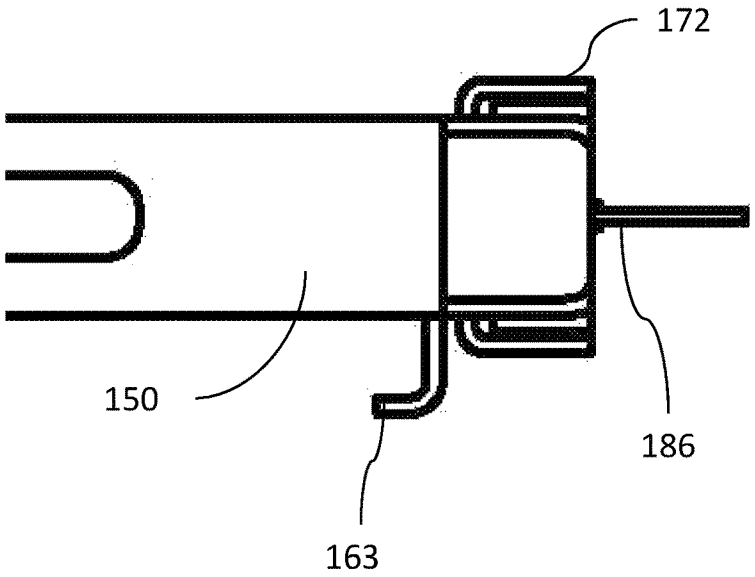
FIG. 4C is a top view of the bidirectional hinge assembly of the container cover system of FIG. 1.
Figure 4B:
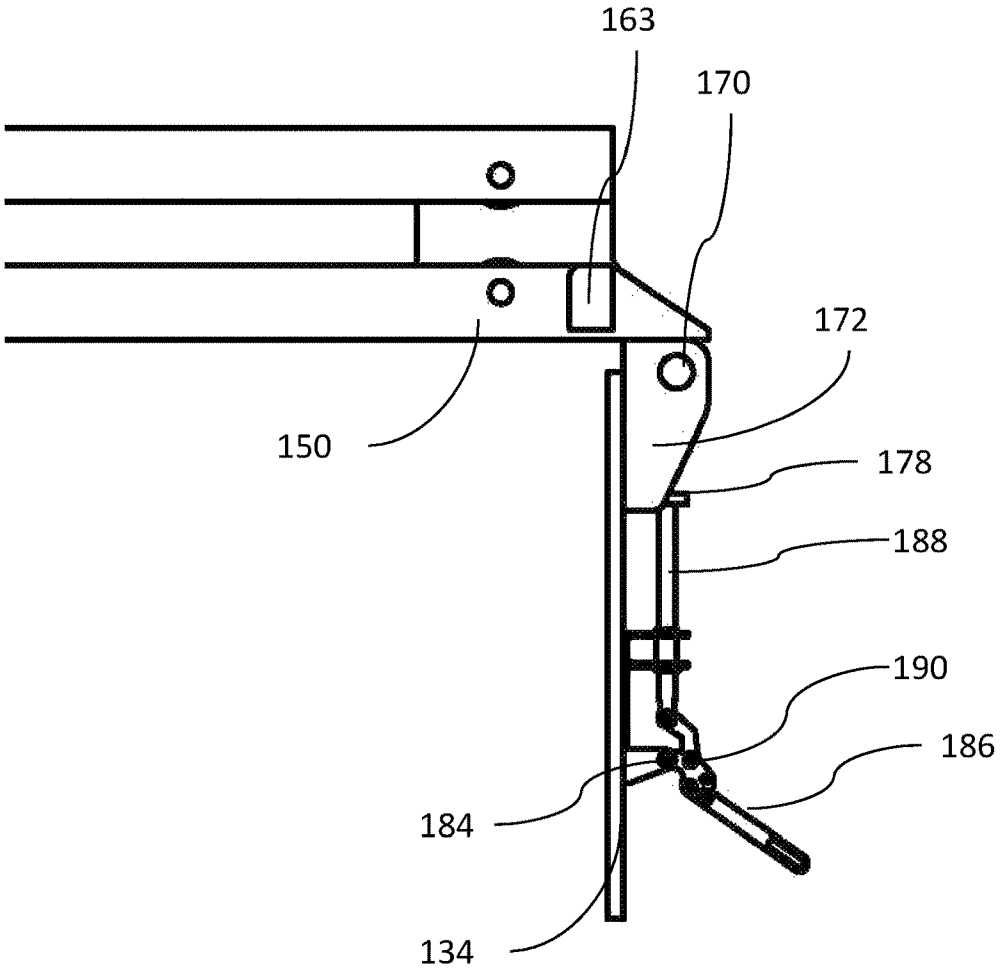
FIG. 4B is a side view of the bidirectional hinge assembly of the container cover system of FIG. 1.
Figure 4F:
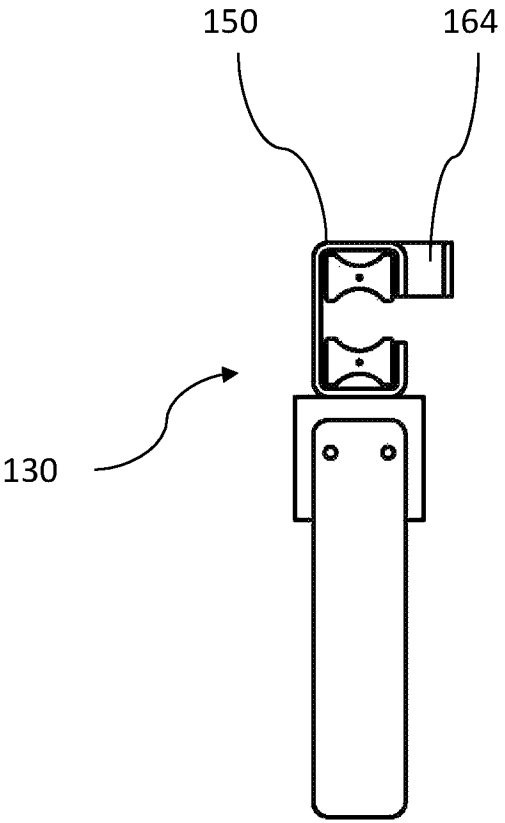
FIG. 4F is an end view of the bidirectional hinge assembly of the container cover system of FIG. 1.
Figure 4D:
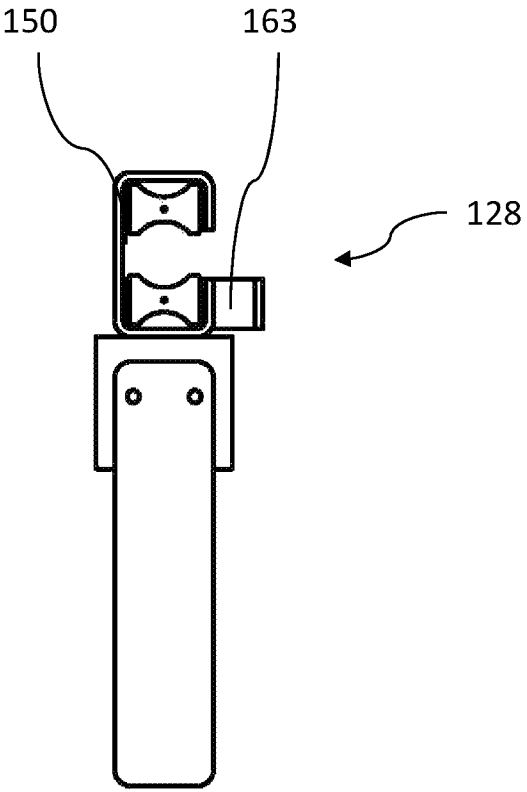
FIG. 4D is an end view of the bidirectional hinge assembly of the container cover system of FIG. 1.

Slide housing 150 also includes a first stop plate 163. First stop plate 163 is coupled adjacent to first end 155 of slide housing 150. First stop plate 163 is configured to engage second stop 144, but not obstruct the movement of first stop 142. Thus, cover assembly 104 can move translatably until second stop 144 engages with stop plate 163. Because second stop 144 is located past the center point of cover assembly 104, cover assembly 104 is biased to rotate open via first cover hinge assembly 128. Correspondingly, second stop plate 164 of second cover hinge assembly 130 serves as a motion stop for first stop 142, but is arranged such that second stop 144 is unobstructed by second stop plate 164. FIG. 4D depicts the arrangement of first stop plate 163 on slide housing 150 of first cover hinge assembly 128. Correspondingly, FIG. 4F depicts the arrangement of second stop plate 164 on slide housing 150 of second cover hinge assembly 130.

Slide housing 150 also includes housing apertures 165 and a centering aperture 166. Housing apertures 165 are sized and shaped to reduce weight of housing 150 without compromising the strength characteristics of slide housing 150. Further, housing apertures 165 of slide housing 150 can be sized and shaped to allow access to the inside of slide housing 150 for maintenance and cleaning purposes. Centering aperture 166 is sized and shaped to receive first centering pin 138 or second centering pin 140. Centering aperture 166 is arranged on a bottom face 167 adjacent a second end 168 of slide housing 150.

Figure 6A:
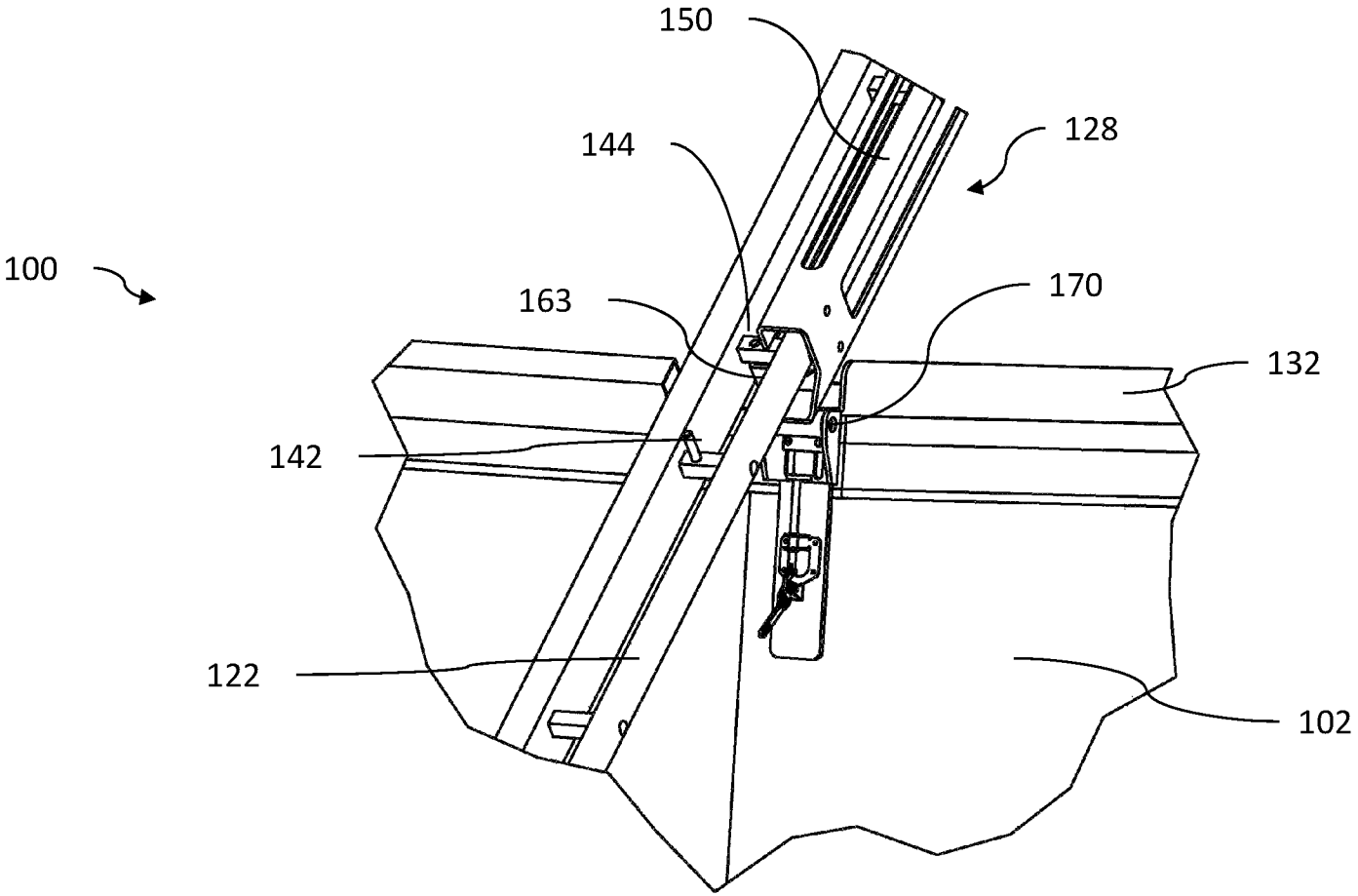
FIG. 6A is a partial isometric view of the bidirectional hinge assembly of the container cover system of FIG. 1.

Slide housing 150 is coupled at first end 155 to a hinge 170. Hinge 170 is coupled to lower hinge plate 172. Lower hinge plate 172 includes hinge apertures 174, slide channels 176, and push tab 178. Hinge apertures 174 are configured to rotatably receive a pin or other protrusion associated with hinge 170. Lower hinge plate 172 is coupled at a substantially perpendicular angle to support bracket 132. Rotatable coupling of slide housing 150 with lower hinge plate 172 at hinge 170 allows slide housing 150, and therefore cover assembly 104 to rotate open and away from support bracket 132, as depicted in FIGS. 6A-7. First cover hinge assembly 128 further includes a mount slider 182. Mount slider 182 rigidly couples to a top portion of first lift mount plate 134 and slidably couples to slide channels 176 of lower hinge plate 172. The slidable coupling of slide channels 176 of lower hinge plate 172 and mount slider 182 is configured to guide vertical movement of cover assembly 104 with respect to container 102. Push tab 178 is arranged on a lower portion of lower hinge plate 172 and is shaped and sized to transfer forces through lower hinge plate 172 through to support bracket 132.

First cover hinge assembly 128 also includes a cover lock 184. Cover lock 184 rigidly couples to first lift mount plate 134. Cover lock 184 further includes a handle 186, pushrod 188, and lever linkage 190. Handle 186 is coupled to a first coupling of lever linkage 190 and pushrod 188 is coupled to a second coupling of lever linkage 190. Pushrod 188 is further coupled to push tab 178 of lower hinge plate 172. Handle 186 includes a graspable portion such that a user can grasp and manipulate handle 186 with relative ease. Lever linkage 190 is configured to transfer motion and force from handle 186 to pushrod 188. Handle 186 and lever linkage 190 can be sized and shaped can act as a force multiplier such that a force applied at the graspable portion of handle 186 is multiplied through lever linkage 190 and passed through to pushrod 188. In this embodiment, a user can manipulate handle 186, for example pushing it upwards, and that motion is transferred through lever linkage 190 and pushrod 188 to lower hinge plate 172 such that cover assembly 104 is lifted as a result. In some embodiments, lever linkage 190 and handle 186 can be configured to be an over-center latch when handle 186 is in a lowered position.

In use, a user can manipulate cover assembly 104 through a closed position, a horizontal sliding position, rotating position, and an open position. Closed position, such as that depicted in FIG. 1, includes cover assembly 104 substantially covering the opening of container 102. Further, closed position also includes cover assembly 104 in a lowered position such that seal 124 is sealably coupled to sealing surface 114 of container 102. In the closed position, the plurality of cover locks 184 can be in a lowered over-center position such that cover locks 184 are providing downward force against the resilient force of seal 124.

Figure 5:
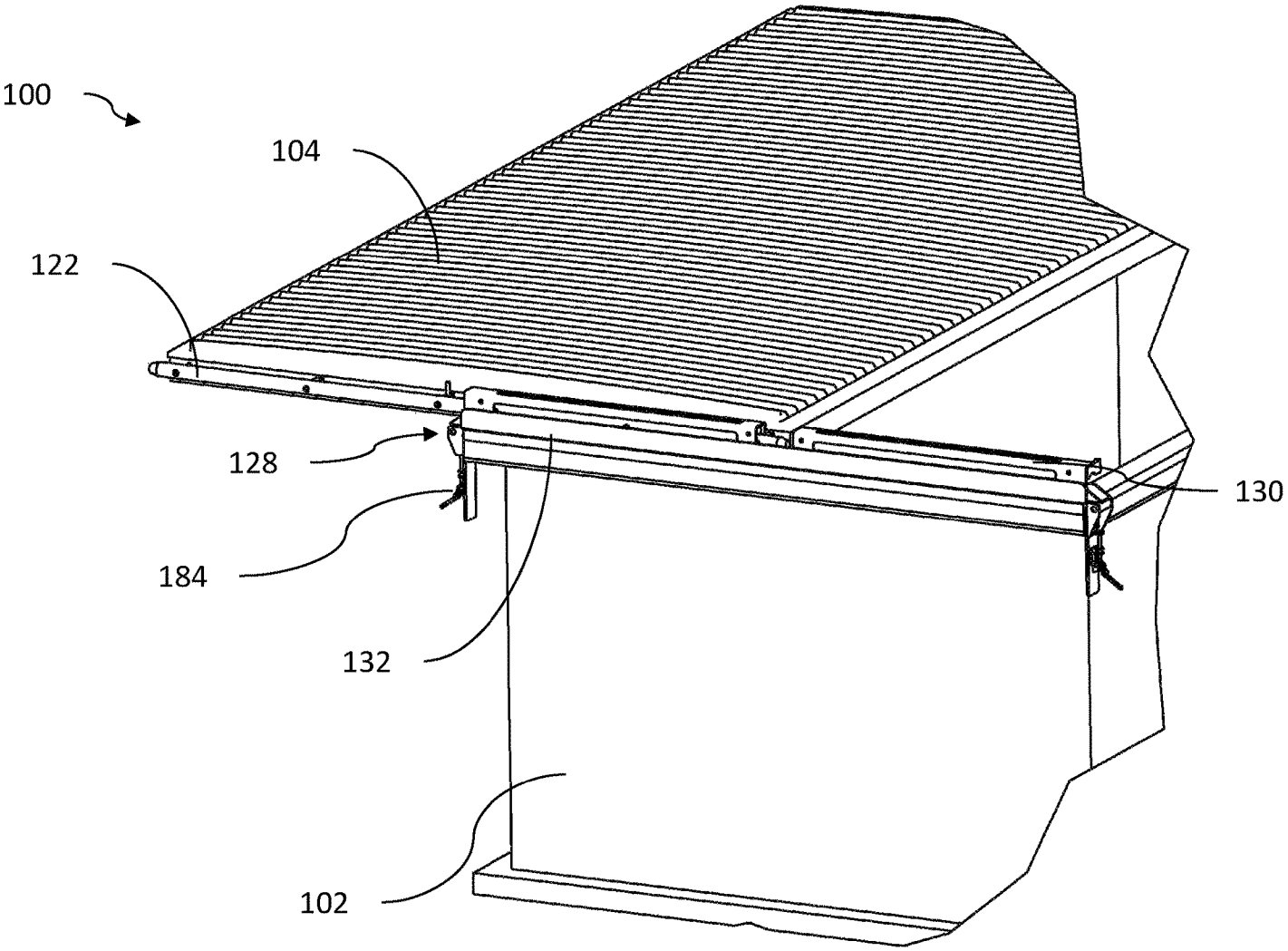
FIG. 5 is a partial isometric view of the container cover system of FIG. 1 with a cover assembly positioned to one side.

Horizontal sliding position, as is depicted in FIG. 5, includes cover assembly 104 in a raised and slidable position. To enter horizontal sliding position from the closed position, the user can lift handle 186 of cover lock 184 at each cover lock 184 location. Lifting each handle 186 causes support bracket 132 to lift further raising cover assembly 104. In the horizontal sliding position, cover assembly 104 is raised such that seal 124 is no longer sealably contacting sealing surface 114 of container 102. In horizontal sliding position, the user can slide cover assembly in either direction via cover rails 122 sliding through first cover hinge assembly 128 and second cover hinge assembly 130.

Figure 6C:
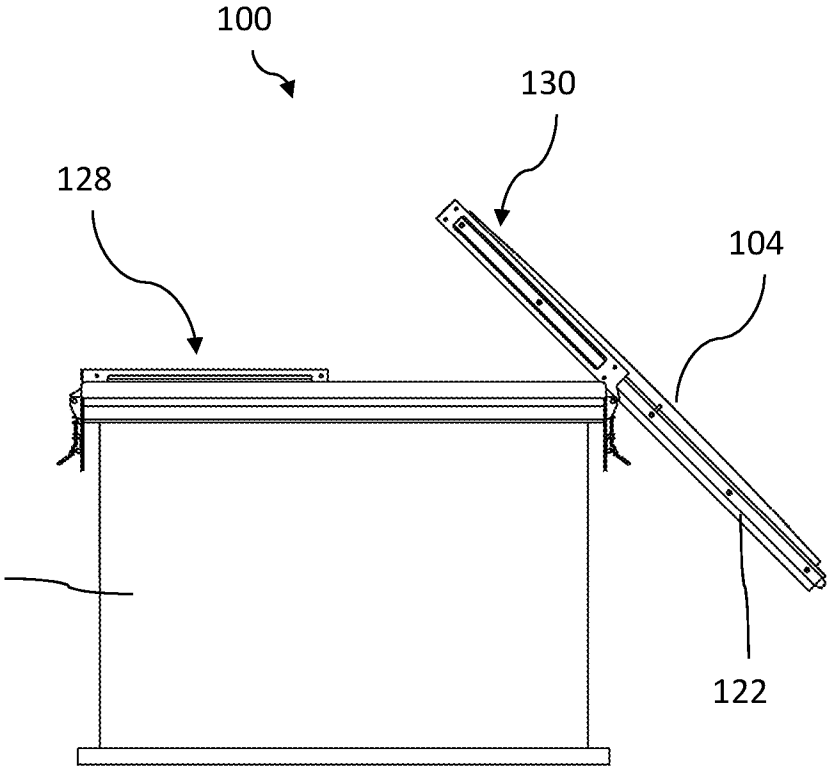
FIG. 6C is a side view of the container cover system of FIG. 1 with the cover assembly rotating off to another side of a container.
Figure 6B:
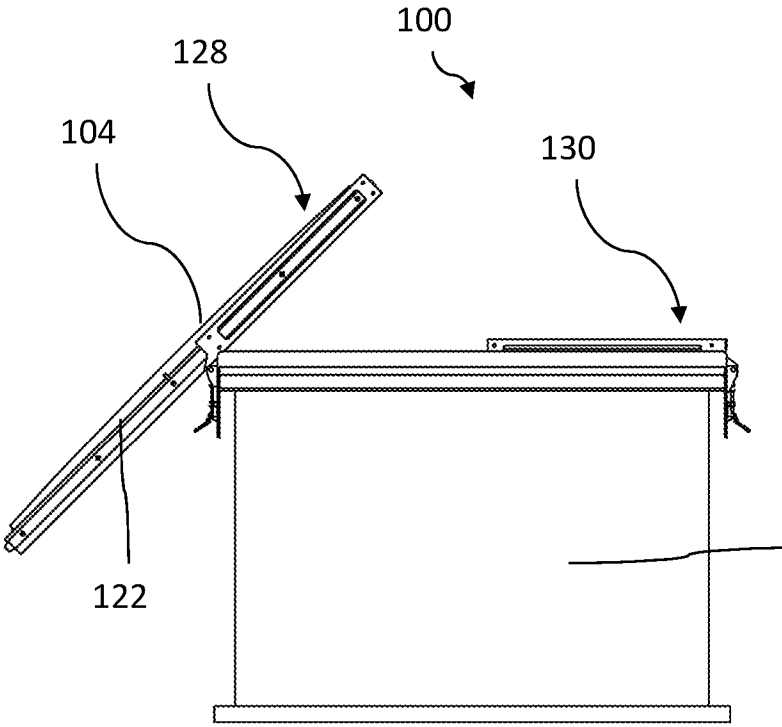
FIG. 6B is a side view of the container cover system of FIG. 1 with the cover assembly rotating off to a side of a container.
Figure 7:
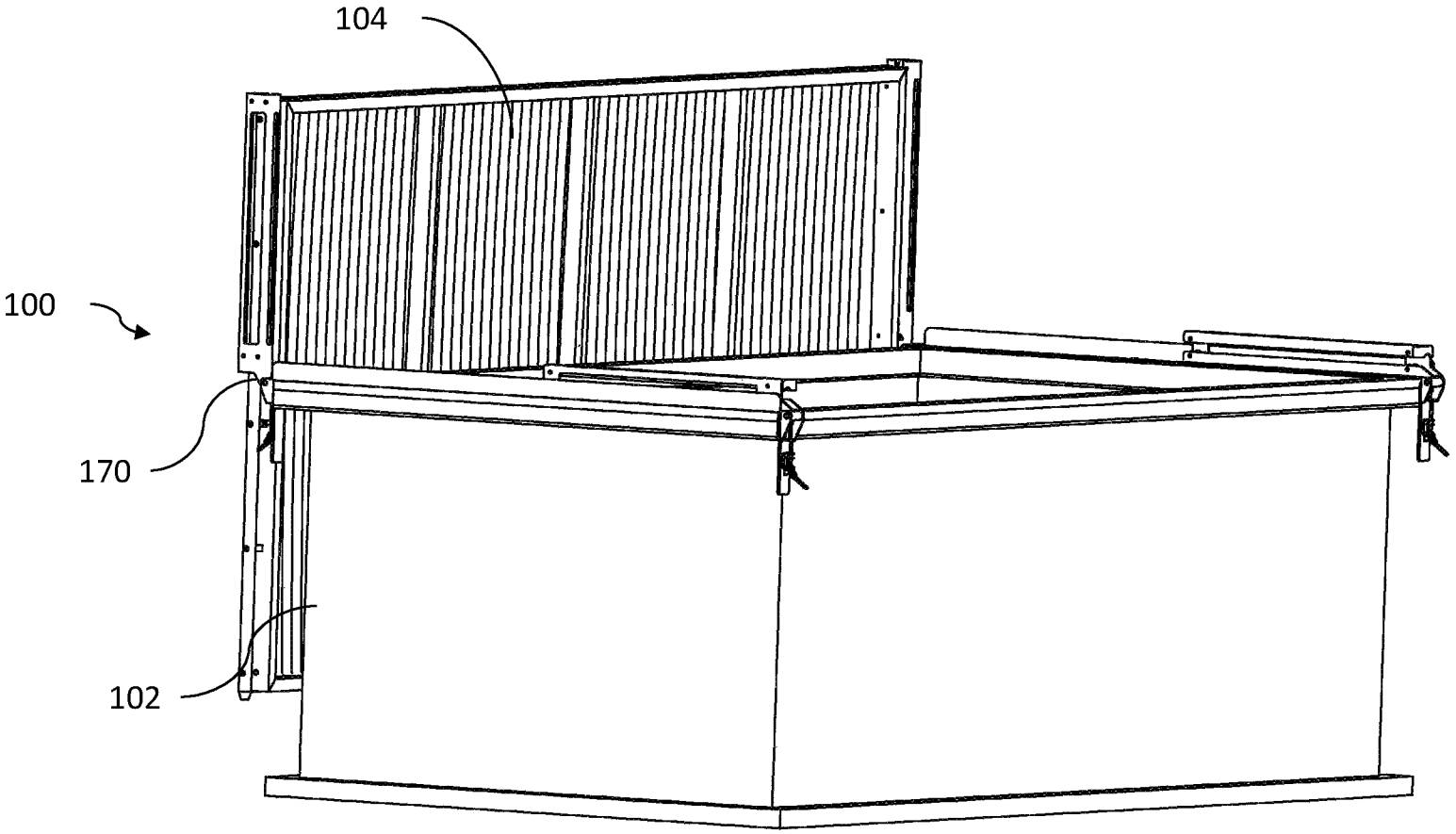
FIG. 7 is an isometric view of the container cover system of FIG. 1 in an open position.

Rotating position, as depicted in FIGS. 6A-6C includes cover assembly 104 being moved by the user in the horizontal sliding position. Cover top 118 is removed from FIG. 6A for clarity. Rotating position includes cover assembly being moved such that first stop plate 163 is engaged with second stop 144 or second stop plate 164 is engaged with first stop 142 depending on which side of container 102 cover assembly 104 is being rotated. In FIG. 6A, for example, second stop 144 is engaged with first stop plate 163 while first stop 142 was unobstructed. Because second stop 144 is offset from the center of cover assembly 104, cover assembly 104 is biased to rotate at hinge 170 due to the center of gravity of cover assembly 104 being cantilevered over the side of container 102.

During rotation in the rotating position, slide housing 150 of first cover hinge assembly 128 rotates at hinge 170 away from support bracket 132. In the rotating position and referring specifically to FIGS. 6B and 6C, cover rail 122 is no longer received in support housing 150 of both first cover hinge assembly 128 and second cover hinge assembly 130. For example and as depicted in FIG. 6B, cover assembly 102 is positioned far enough to the first side of container 102 such that cover rail 122 is removed from second cover hinge assembly 130 and is only supported by first cover hinge assembly 128. Conversely, and as depicted in FIG. 6C, cover assembly 102 is positioned far enough to the second side of container 102 such that cover rail 122 is removed from first cover hinge assembly 128 and is only supported by second cover hinge assembly 130.

When the user transitions from rotating position to horizontal position on the first side of container cover system 100, slide housing 150 is guided into horizontal position by receiving first centering pin 138 within one of the centering apertures 166. Conversely, when the user transitions from rotating position to horizontal position on the second side of container cover system 100, slide housing 150 is guided into horizontal position by receiving first centering pin 140 within one of the centering apertures 166.

Open position, as depicted in FIG. 7, includes the user rotating cover assembly 104 about hinge 170 to a fully open position. In open position, cover assembly 104 is positioned such that the opening to container 102 is substantially unencumbered by cover assembly 104.

Figure 8:
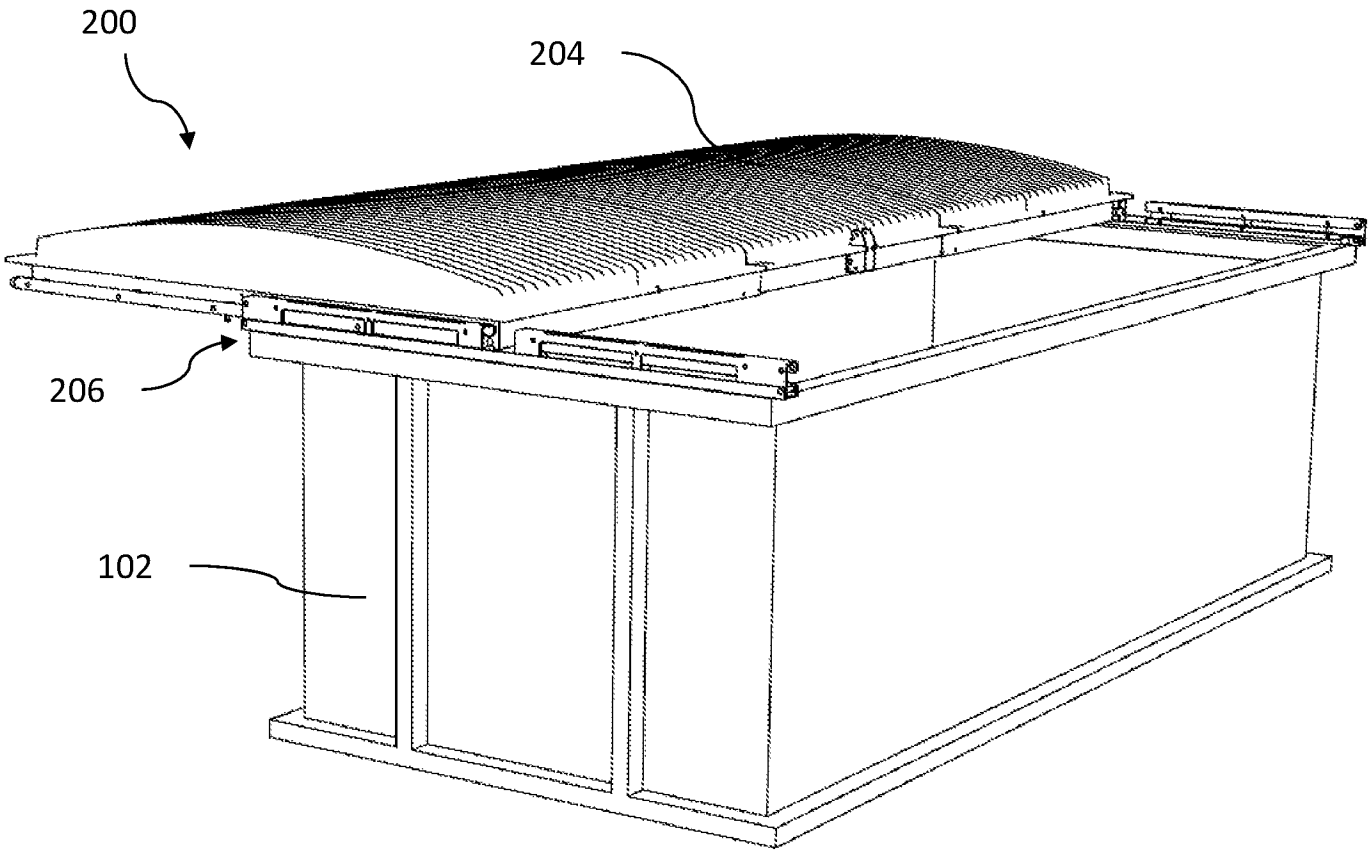
FIG. 8 is a perspective view of container cover system in a partially open position, according to another embodiment.

Another embodiment of a container cover system is depicted in FIGS. 8-12. Referring now to FIG. 8, a container cover system 200 is depicted and includes a cover assembly 204, and a plurality of bidirectional cover opening mechanisms 206. Cover assembly 204 is slidably coupleable to bidirectional cover opening mechanisms 206 arranged on either end of a container 102. Cover assembly 204 is further configured to cover the opening of the containing portion of container housing 110. The plurality of bidirectional cover opening mechanisms 206 are coupled to container 102 such that cover assembly 204 can rotate open via the plurality of bidirectional cover opening mechanisms 206.

Figure 9:
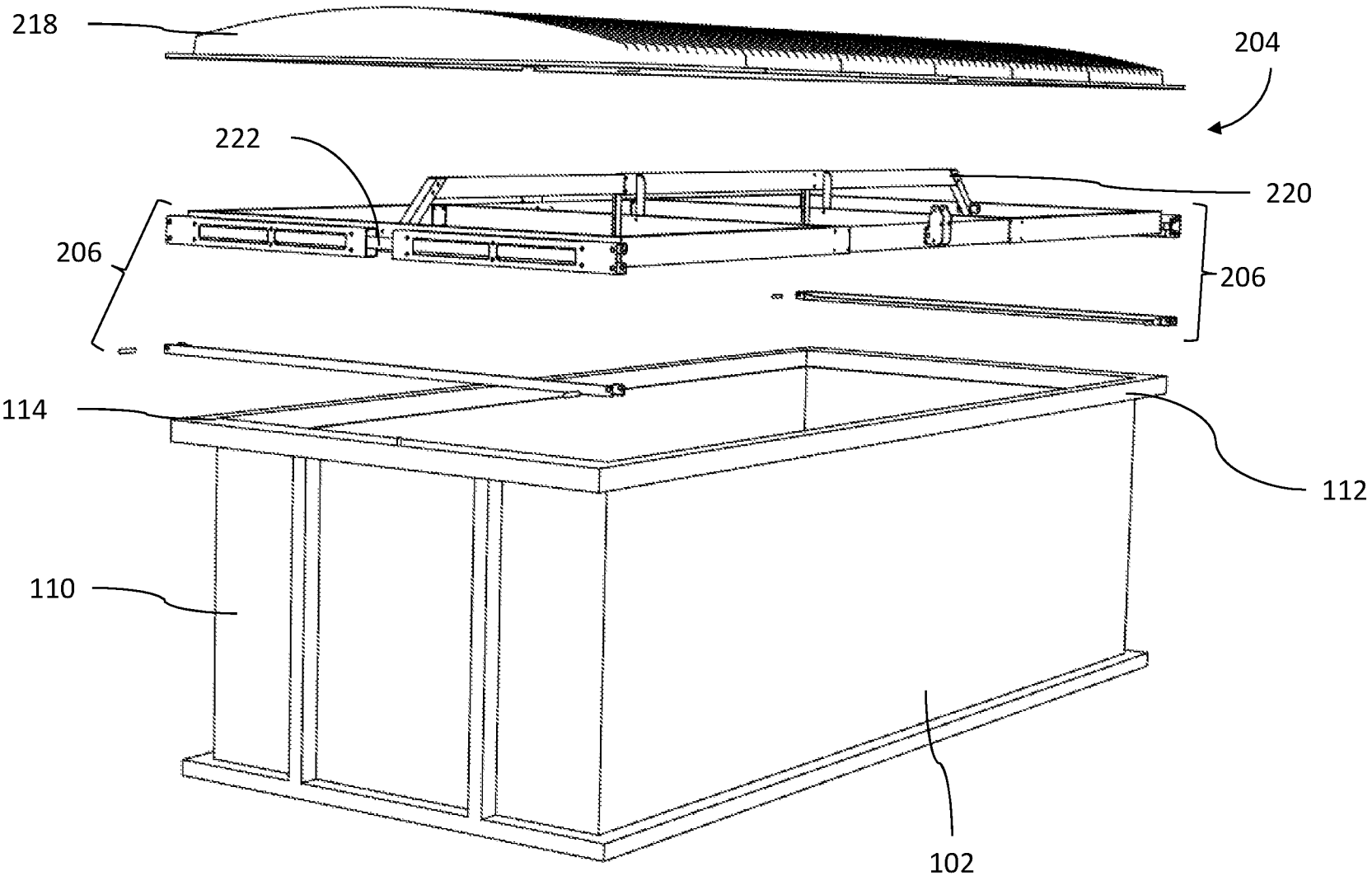
FIG. 9 is an exploded view of the container cover system of FIG. 8.

Referring now to FIG. 9, cover assembly 204 can include a cover top 218, cover frame 220, and cover rails 222. Cover top 218 is fixedly coupled to cover frame 220 and is sized and shaped to substantially cover the opening of the containing portion of container housing 110. Cover top 218 can be made of various materials such as steel or other metals, wood, plastic, or other manufactured material suitable for covering waste material. Cover top 218 is substantially similar to cover top 118 of the first embodiment but includes a more pronounced crown for heightened draining performance. Cover frame 220 includes a plurality of structural beams configured to support cover top 218. Cover frame 220 is substantially similar to cover frame 120 but includes structural beams configured to support the pronounced crown of cover top 218.

Cover rails 222 are fixedly coupled to a first end and a second end of cover frame 220 via a plurality of rail mounts 126 in the same way cover rails 222 couple to cover frame 120 in FIGS. 2B and 3.

Figure 10A:
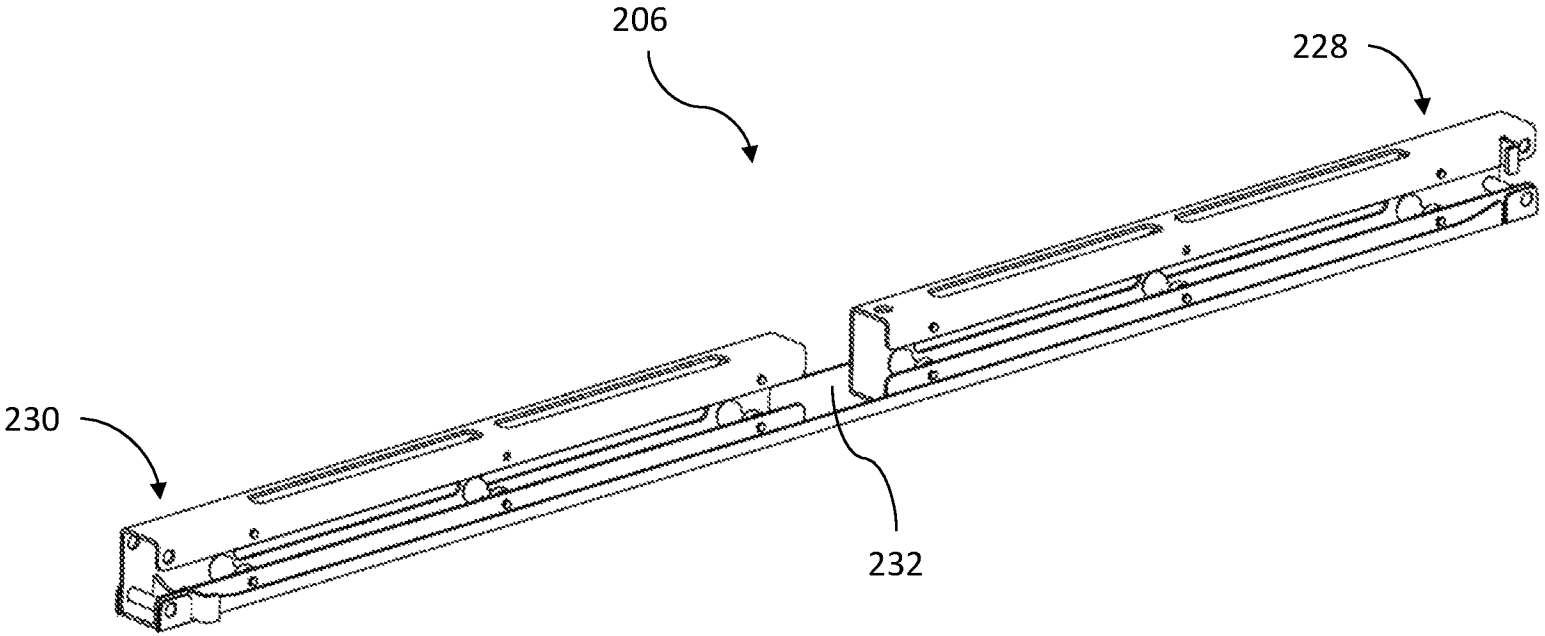
FIG. 10A is an isometric view of a bidirectional hinge assembly of the container system of FIG. 8.

Referring now to FIG. 10A, the first end and the second end of container cover system 200 are substantially similar and construction of only one end will be described below as it applies equally to the construction of the second end. In an embodiment, bidirectional cover opening mechanism 206 includes a first cover hinge assembly 228, a second cover hinge assembly 230, and a support bracket 232. Bidirectional cover opening mechanism 206 components can be made of steel, aluminum, other suitable metal material, plastic, or other suitable manufactured material. First cover hinge assembly 228 is hingedly coupled to a first end of support bracket 232 and second cover hinge assembly 230 is hingedly coupled to a second end of support bracket 232. Support bracket 232 is sized and shaped to span the length of an end of upper collar 112 of container 102. In this embodiment, support bracket 232 is fixedly coupled to upper collar 112 via suitable fixation means as known in the art.

Figure 10B:
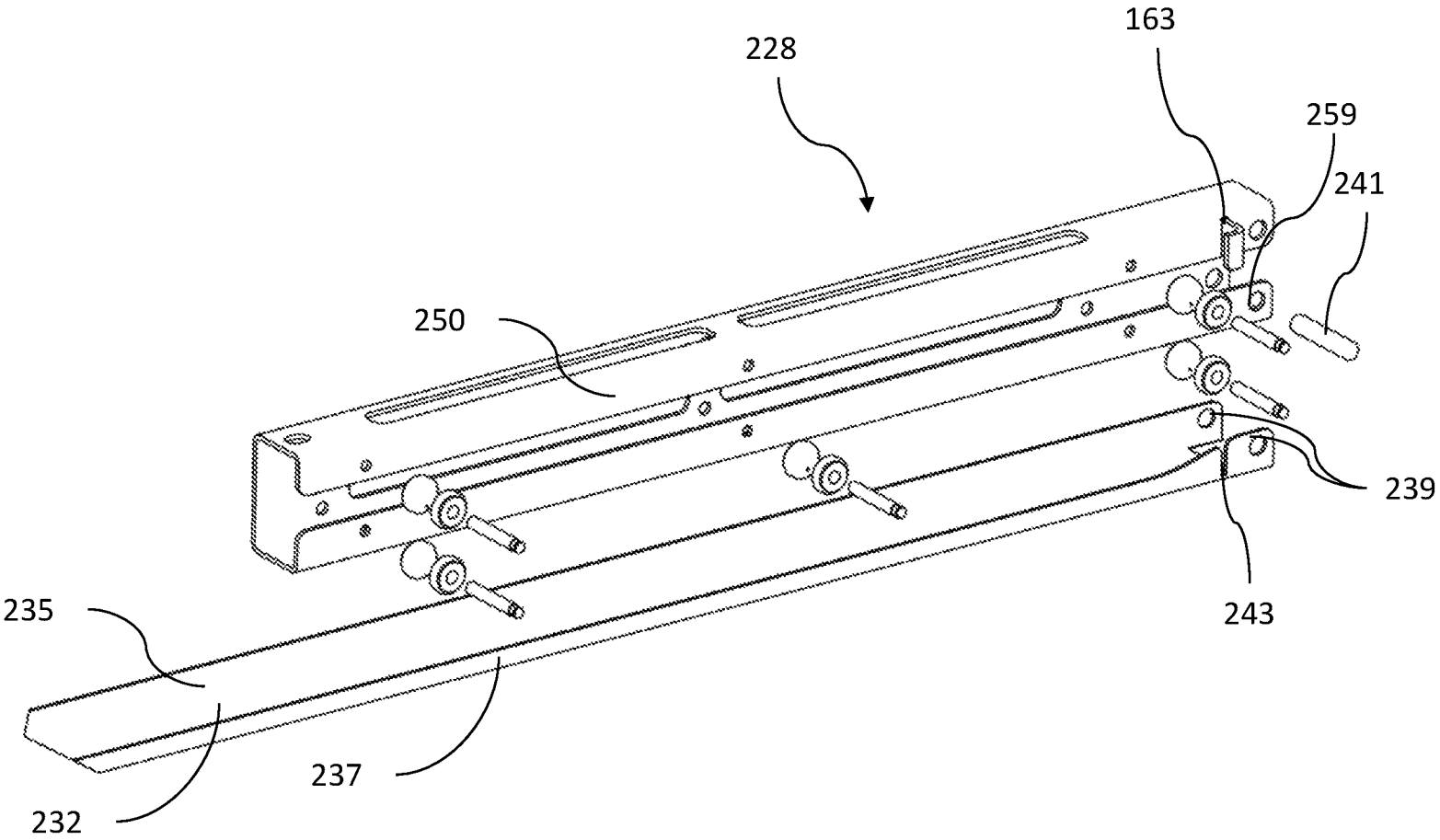
FIG. 10B is an exploded view of the bidirectional hinge assembly of the container system of FIG. 8.

Referring now to FIG. 10B depicting first cover hinge assembly 228 and the first end of support bracket 232, support bracket 232 includes an outer wall 235 and an inner wall 237. Outer wall 235 and inner wall 237 include hinge apertures 239 configured for receiving a hinge pin 241. Hinge apertures 239 are arranged proximate the ends of support bracket 232. Inner wall 237 further includes recesses 243 configured to receive first stop plate 163 or second stop plate 164 of first cover hinge assembly 228 or second cover hinge assembly 230. In some embodiments, inner wall 237 only includes one recess 243 arranged at the end requiring clearance for first stop plate 163 or second stop plate 164. For example, inner wall 237 could only include recess 243 at the second end of support bracket 232 where first stop plate 163 would otherwise intersect inner wall 237. In this example, there is no recess 243 arranged at the second end of support bracket 232 as second stop plate 164 does not intersect inner wall 237.

First cover hinge assembly 228 includes slide housing 250. Slide housing 250 is substantially similar to slide housing 150 except that slide housing 250 does not include hinge 170. Instead, slide housing 250 includes a hinge aperture 259 arranged at the end of slide housing 250 and arranged such that hinge aperture 259 receives hinge pin 241. Thus, first cover hinge assembly 228 rotatably couples to the first end of support bracket 232 via hinge pin 241 being received by both hinge apertures 239 and 259.

It is appreciated that first cover hinge assembly 228 is substantially similar to second cover hinge assembly 230 with the exception of the location of hinging components. Because first cover hinge assembly 228 is substantially similar to second cover hinge assembly 230, only first cover hinge assembly 228 is described below, but said description applies to the construction of second cover hinge assembly 230.

In use, the user can manipulate cover assembly 204 through a closed position, a horizontal sliding position, rotating position, and an open position. Closed position includes cover assembly 204 substantially covering the opening of container 102. Horizontal sliding position, however, differs in cover container system 200 in that cover assembly 204 does not have to be lifted from closed position to the horizontal sliding position.

In horizontal sliding position, the user can slide cover assembly 200 in either direction via cover rails 222 sliding through first cover hinge assembly 228 and second cover hinge assembly 230.

Figure 11:
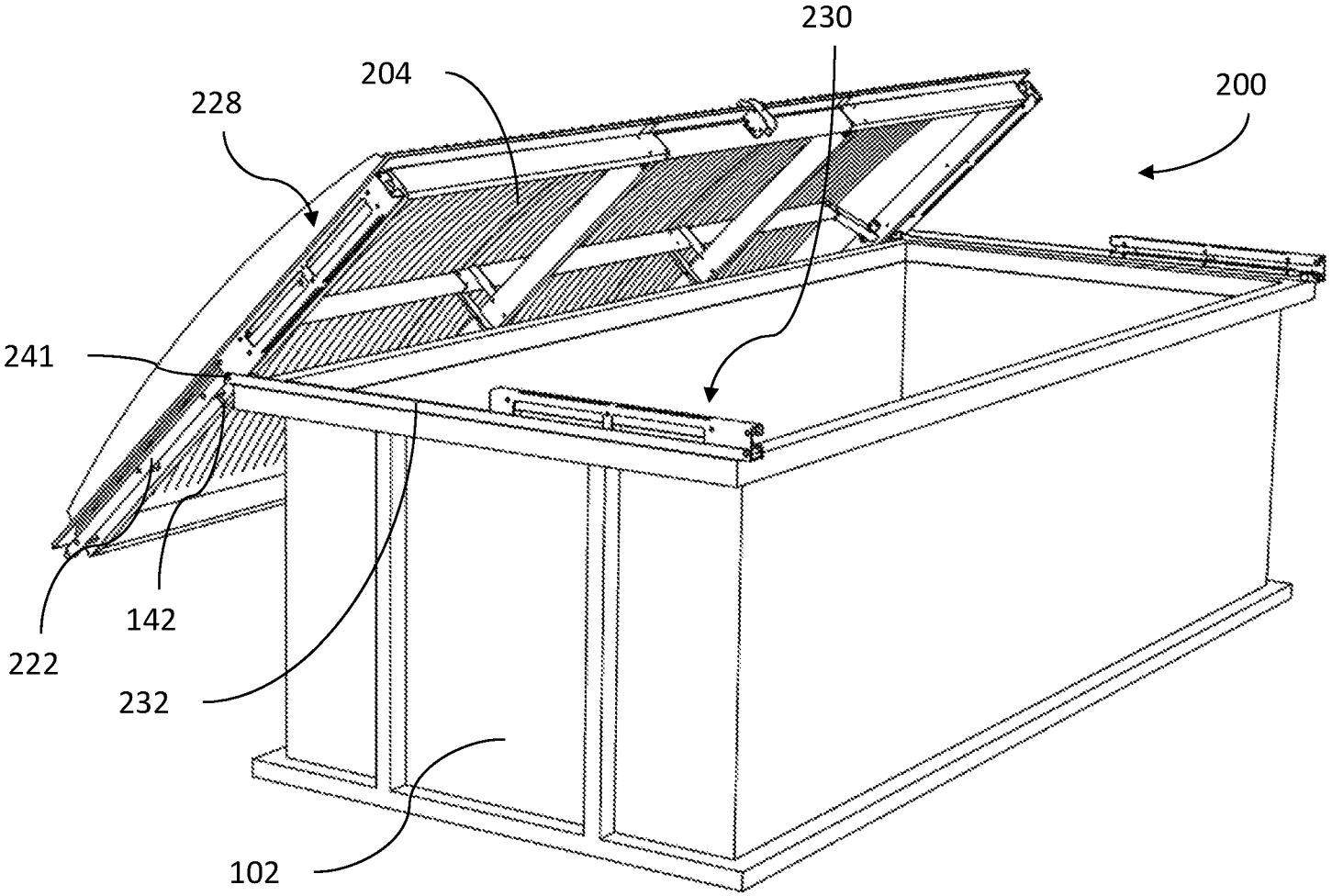
FIG. 11 is an isometric view of the container cover system of FIG. 8 with the cover assembly rotating off to a side of a container.

Rotating position, as depicted in FIGS. 8 and 11, includes cover assembly 204 being moved by the user to either end of motion of the horizontal sliding position. Rotating position includes cover assembly being moved such that first stop plate 163 is engaged with second stop 144 or second stop plate 164 is engaged with first stop 142 depending on which side of container 102 cover assembly 204 is being rotated. In FIG. 11 and FIG. 6A, for example, second stop 144 is engaged with first stop plate 163 while first stop 142 is unobstructed. Because second stop 144 is offset from the center of cover assembly 204, cover assembly 204 is biased to rotate at about hinge pin 241 due to the center of gravity of cover assembly 204 being cantilevered over the side of container 102. See FIG. 6A for detailed depiction of the rotating position of cover assembly 100 and 200.

During rotation in rotating position, slide housing 250 of second cover hinge assembly 230 rotates at hinge pin 241 away from support bracket 232. In the rotating position, and referring specifically to FIG. 11, cover rail 122 is no longer received in the slide housing of second cover hinge assembly 230. For example, and as depicted in FIG. 11, cover assembly 204 is positioned far enough to the first side of container 102 such that cover rail 122 is removed from second cover hinge assembly 230 and is only supported by first cover hinge assembly 228. Conversely, cover assembly 102 can be positioned far enough to the second side of container 102 such that cover rail 122 is removed from first cover hinge assembly 228 and is only supported by second cover hinge assembly 130. See FIG. 6C for representative positioning using container cover system 100.

When the user transitions from rotating position to horizontal position on the first side of container cover system 200, slide housing 250 of first cover hinge assembly 228 is received between inner wall 237 and outer wall 235 of support bracket 232. Conversely, when the user transitions from rotating position to horizontal position on the second side of container cover system 200, slide housing 250 of second cover hinge assembly 228 is received between inner wall 237 and outer wall 235 of support bracket 232.

Figure 12:
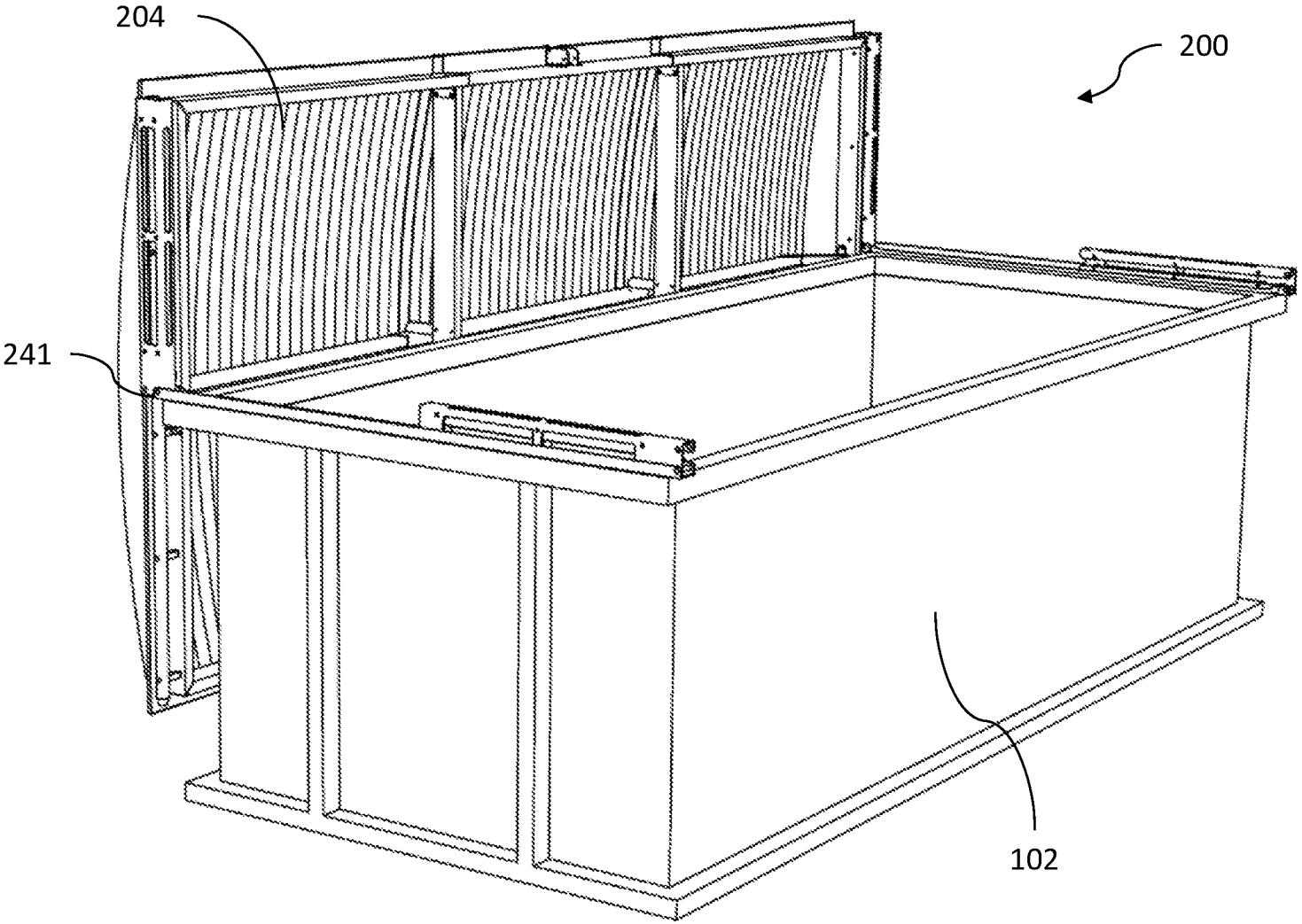
FIG. 12 is an isometric view of the container cover system of FIG. 7 in an open position.

Open position, as depicted in FIG. 12, includes the user rotating cover assembly 204 about hinge pin 241 to a fully open position. In open position, cover assembly 204 is positioned such that the opening to container 102 is substantially unencumbered by cover assembly 204.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

The invention claimed is:

1. A cover assembly for a container, comprising:

a frame, including a rail;

a cover coupled to the frame;

a first opening mechanism including a first pivot and a first slide housing;

a second opening mechanism including a second pivot and a second slide housing, the rail of the frame being selectively and slidingly receivable in the first and second slide housings, wherein the cover and frame are movable between three positions:

a closed position which substantially covers an opening of the container, a first open position wherein the rail is at least partially disposed in the first slide housing and the rail is disengaged from the second slide housing, and the frame, cover and first slide housing are rotated about the first pivot to allow access to a substantial portion of the opening of the container, and a second open position wherein the rail is at least partially disposed in the second slide housing and the rail is disengaged from the first slide housing, and the frame, cover and second slide housing are rotated about the second pivot to allow access to a substantial portion of the opening of the container.

2. The cover assembly of claim 1, wherein the orientation of the cover and the frame in the closed position is generally orthogonal to the orientation of the cover and the frame in each of the two open positions.

3. The cover assembly of claim 1, wherein the first slide housing and the second slide housing are generally arranged end to end.

4. The cover assembly of claim 1, wherein the first opening mechanism includes a first stop plate configured to limit translation of the frame and cover in a first direction.

5. The cover assembly of claim 1, wherein the second opening mechanism includes a second stop plate configured to limit translation of the frame and cover in a second direction.

6. The cover assembly of claim 1, wherein each of the first and second slide housings include rollers disposed therein, the rail being selectively and slidingly receivable by the rollers.

7. A cover assembly for a container, comprising:

a frame, including a rail and a seal, the seal being configured to engage an opening of the container;

a cover coupled to the frame;

a cover support assembly including a lifting support bracket and one or more cover locks, the cover locks coupled to a first and second end of the lifting support bracket, the cover locks configured to raise and lower the lifting support bracket;

a first opening mechanism including a first pivot and a first slide housing, the first opening mechanism coupled to the first end of the lifting support bracket;

a second opening mechanism including a second pivot and a second slide housing, the second opening mechanism coupled to the second end of the lifting support bracket, the rail of the frame being selectively and slidingly receivable in the first and second slide housings, wherein the cover and frame are movable between three positions:

a closed position which substantially covers the opening of the container and the cover support assembly is in a lowered position such that the seal is coupled to the opening of the container, a first open position wherein the rail is at least partially disposed in the first slide housing and is disengaged from the second slide housing, and the frame, cover and first slide housing are rotated about the first pivot to allow access to a substantial portion of the opening of the container, and the cover support assembly is in a raised position such that the seal is not coupled to the opening of the container, and a second open position wherein the rail is at least partially disposed in the second slide housing and is disengaged from the first slide housing, and the frame, cover and second slide housing are rotated about the second pivot to allow access to a substantial portion of the opening of the container, and the cover support assembly is in a raised position such that the seal is not coupled to the opening of the container.

8. The cover assembly of claim 7, wherein the orientation of the cover and the frame in the closed position is generally orthogonal to the orientation of the cover and the frame in each of the two open positions.

9. The cover assembly of claim 7, wherein the first slide housing and the second slide housing are generally arranged end to end.

10. The cover assembly of claim 7, wherein the first opening mechanism includes a first stop plate configured to limit translation of the frame and cover in a first direction.

11. The cover assembly of claim 7, wherein the second opening mechanism includes a second stop plate configured to limit translation of the frame and cover in a second direction.

12. The cover assembly of claim 7, wherein each of the first and second slide housings include rollers disposed therein, the rail being selectively and slidingly receivable by the rollers.

13. The cover assembly of claim 7, wherein each of the cover locks include a lever and a linkage assembly, the lever and linkage assembly configured to raise and lower the lifting support bracket such that the seal can engage or disengage the opening of the container.

14. A cover system for a container, comprising:

a cover assembly including:

a frame, a cover coupled to a top portion of the frame, one or more rails coupled to a side portion of the frame, and a seal coupled to a bottom portion of the frame, the seal configured to engage with an opening of the container; and one or more hinge assemblies slidably coupled to the one or more rails of the cover assembly, one of the one or more hinge assemblies including:

a lifting support bracket, a first opening mechanism including a first pivot and a first slide housing, the first opening mechanism coupled to the first end of the lifting support bracket, a second opening mechanism including a second pivot and a second slide housing, the second opening mechanism coupled to the second end of the lifting support bracket, the rail of the frame being selectively and slidingly receivable in the first and second slide housings, and one or more cover locks, the cover locks coupled to a first and second end of the lifting support bracket, the cover locks configured to raise and lower the lifting support bracket such that the seal raises or lowers to engage with the opening of the container.

15. The cover system of claim 14, wherein the first opening mechanism is configured to allow the cover assembly to slide and rotate about the first end of the lifting support bracket such that the orientation of the cover assembly in a closed position is generally orthogonal to the orientation of the cover assembly in an open position.

16. The cover system of claim 14, wherein the second opening mechanism is configured to allow the cover assembly to slide and rotate about the second end of the lifting support bracket such that the orientation of the cover assembly in a closed position is generally orthogonal to the orientation of the cover assembly in an open position.

17. The cover system of claim 14, wherein the first opening mechanism includes a first stop plate configured to limit translation of the cover assembly in a first direction.

18. The cover system of claim 14, wherein the second opening mechanism includes a second stop plate configured to limit translation of the cover assembly in a second direction.

19. The cover system of claim 14, wherein each of the first and second slide housings include rollers disposed therein, the one or more rails being selectively and slidingly receivable by the rollers.

20. The cover system of claim 14, wherein each of the cover locks include a lever and a linkage assembly, such that the lever is manipulatable by a user.

* * * * *